US009395152B2

(12) United States Patent
Barnhart

(10) Patent No.: US 9,395,152 B2
(45) Date of Patent: Jul. 19, 2016

(54) ARTWORK DISPLAY FRAME AND RELATED METHODS

(71) Applicant: America Grip, LLC, Austin, TX (US)

(72) Inventor: Dan Barnhart, Austin, TX (US)

(73) Assignee: America Grip, LLC

( * ) Notice: Subject to any disclaimer, the term of this patent is extended or adjusted under 35 U.S.C. 154(b) by 0 days.

(21) Appl. No.: 14/522,935

(22) Filed: Oct. 24, 2014

(65) Prior Publication Data

US 2015/0159978 A1 Jun. 11, 2015

Related U.S. Application Data

(63) Continuation of application No. 14/074,561, filed on Nov. 7, 2013, now Pat. No. 9,115,955.

(51) Int. Cl.

| | |
|---|---|
| ***F41C 23/16*** | (2006.01) |
| ***A47G 1/06*** | (2006.01) |
| ***G09F 23/00*** | (2006.01) |

(52) U.S. Cl.

CPC . *F41C 23/16* (2013.01); *A47G 1/06* (2013.01); *G09F 23/00* (2013.01)

(58) Field of Classification Search

CPC ..... F41C 23/16; F41C 23/22; A47G 1/06; G09F 23/00; G09F 7/18

USPC ..... 42/71.01, 96, 90, 106, 108; D22/108

See application file for complete search history.

(56) References Cited

U.S. PATENT DOCUMENTS

| | | | | |
|---|---|---|---|---|
| 6,609,321 | B2 * | 8/2003 | Faifer | 42/71.01 |
| 6,725,594 | B2 * | 4/2004 | Hines | 42/90 |
| 7,430,828 | B2 * | 10/2008 | Munst | 42/72 |
| 7,856,749 | B2 * | 12/2010 | Fitzpatrick et al. | 42/96 |
| D704,789 | S * | 5/2014 | Fitzpatrick et al. | D22/108 |
| D704,791 | S * | 5/2014 | Fitzpatrick et al. | D22/108 |
| 8,935,874 | B2 * | 1/2015 | Troy | 42/90 |
| 2007/0006509 | A1 * | 1/2007 | DeSomma et al. | 42/72 |

* cited by examiner

*Primary Examiner* — Joshua Freeman

(74) *Attorney, Agent, or Firm* — The Villhard Patent Group

(57) ABSTRACT

Frames for displaying 3D and/or user-selected pieces of artwork and related methods. Some frames comprise frame and rail engagement portions. The frame portions display the artwork and further comprise bodies defining curvilinear cross-sections and display areas on exterior surfaces of the bodies. The rail-engagement portions can couple to the frame portions and further comprise ridges. The ridges extend away from interior surfaces of the frame bodies and can be adapted to engage rails. Flats adjacent to the rails can facilitate securing the frames to the rails. Moreover, display areas of the current embodiment define the artwork. The bodies and rail engagement portions can withstand various shocks at the rails. Moreover, the bodies can be hand guards for weapons. Furthermore, the rail engagement portions can define apertures which receive weapons tools. Moreover, the frame portions can define stops which engage slots associated with the rails. If desired, engravings define the artwork.

17 Claims, 17 Drawing Sheets

VIEW AA VIEW BB

ARTWORK DISPLAY FRAME AND RELATED METHODS

This application is a continuation in part of non-provisional patent application Ser. No. 14/074,561, filed on Nov. 7, 2013, by Daniel Barnhart and entitled Artwork Display Frame and Related Methods which is a non-provisional application of and claims priority to provisional U.S. Patent Application No. 61/818,984, filed on May 3, 2013, by Daniel Barnhart, and entitled Weapon With Artwork Surface the entirety of which are incorporated herein as if set forth in full.

BACKGROUND

Much artwork is delicate and not suitable for surviving harsh environments such as those found on (and/or associated with) automatic weapons. For instance, artwork displayed on paper, fabric, etc. would deteriorate rapidly under the influence of the shock and vibration present on most automatic weapons due to their "firing." Likewise, heat can be a factor limiting a user's ability to place artwork in certain environments (such as on their weapons) particularly if the artwork sags or might otherwise contact potentially hot objects in the environment (such as, again, the barrel of a weapon). The user's incidental or accidental handling of the artwork might also cause degradation of the artwork. For instance, Should a user somehow affix artwork to a weapon, their handling of the weapon would likely expose the artwork to the forces inherent in gripping the weapon as they move through brush and position and/or fire it. Moreover, the design and/or functional characteristics of most weapons limit the number and size of surfaces available for anything but utilitarian functions leaving little (if any) room for artwork to be applied thereto. Yet many gun owners wish to personalize their weapons.

SUMMARY

The following presents a simplified summary in order to provide an understanding of some aspects of the disclosed subject matter. This summary is not an extensive overview of the disclosed subject matter, and is not intended to identify key/critical elements or to delineate the scope of such subject matter. A purpose of the summary is to present some concepts in a simplified form as a prelude to the more detailed disclosure that is presented herein. The current disclosure provides systems, apparatus, methods, etc. for displaying artwork and more specifically for displaying artwork in environments wherein the artwork might be subject to shock, thermal extremes, mishandling, etc.

Some embodiments provide frames for displaying three-dimensional and user-selected pieces of artwork wherein the frames comprise frame portions and rail engagement portions. In some embodiments the frame portions are adapted to display the pieces of artwork and further comprise frame bodies defining generally arc-shaped cross-sections (as viewed along longitudinal axes of the frame bodies) and display areas disposed on exterior surfaces of the arc-shaped frame bodies. The rail-engagement portions of the current embodiment couple to the frame portions and further comprise pairs of ridges. These ridges extend generally inwardly from interior surfaces of the arc-shaped frame bodies and are adapted to engage tactical rails. Moreover, the display areas of the current embodiment define three-dimensional and user-selected pieces of artwork therein and/or thereon.

The frame bodies and rail engagement portions can be adapted to withstand shocks of at least 45 foot-pounds transmitted from the pairs of rails applied at least 10,000 times and (in some embodiments) hundreds of thousands of times. In the alternative, or in addition, the frame bodies can define flats generally adjacent to the ridges and these flats can be configured to increase (static) friction between the artwork frames and the tactical rails. In some embodiments the frame bodies are adapted to be hand guards for automatic weapons and/or the pairs of ridges can be adapted to engage Picattiny rails. In the alternative, or in addition, the rail engagement portions (and perhaps other portions) define tool apertures adapted to receive weapons tools. Thus, when the ridges are engaged with the tactical rails and the tool apertures have received the weapons tools, the weapons tools engage slots associated with the tactical rails. Moreover, the artwork frame portions can define stops adapted to engage slots associated with the tactical rails. If desired, engravings define the three-dimensional and user-selected pieces of artwork. In some embodiments, the artwork defines thinned sections of the frame bodies.

Some embodiments provide hand guards for weapons which include barrels. Such hand guards comprise frame portions which are adapted to display pieces of artwork. Furthermore, the artwork frame portions further comprise frame bodies and rail engagement portions. The frame bodies define generally arc-shaped cross-sections and display areas disposed on exterior surfaces of the arc-shaped frame bodies. The rail-engagement portions couple to the frame portions and further comprise pairs of ridges extending generally inwardly from interior surfaces of the arc-shaped frame bodies and are adapted to engage tactical rails. In addition, the display areas define the pieces of artwork therein.

Embodiments provide interlocking artwork frames and/or hand guards for weapons. More specifically, some artwork frames comprise frame portion, a frame body, rail-engagement portions and a first half of a coupling. The frame body defines a first edge and a display area disposed on the exterior surface of the artwork frame. In the current embodiment, the rail-engagement portions couple to the frame portion and comprise a pair of ridges which are adapted to engage tactical rails. Furthermore, the first coupling half of the current embodiment is located at the first edge of the frame body and is adapted to mate with a second half of the coupling to releasably couple the artwork frame to the second coupling half.

In some artwork frames, an engraving defines the artwork and/or the first coupling half defines a tool aperture. Moreover, the frame body can define a second edge spaced apart from the first edge by the display area. Furthermore, the artwork frame can comprise a second coupling half located at the second edge which is adapted to mate with the first coupling half of another artwork frame. Note that the second coupling half could also define a weapon aperture and/or a portion of the rail-engagement portion. If desired, the artwork frame can comprise a first stop adapted to engage a groove of the tactical rain when the artwork frame is on the tactical rail. That stop can define one half of a weapons aperture and/or an attachment point for a crush pad. Note that the first coupling half can define at least a part of the rail-engagement portion.

To the accomplishment of the foregoing and related ends, certain illustrative aspects are described herein in connection with the annexed figures. These aspects are indicative of various non-limiting ways in which the disclosed subject matter may be practiced, all of which are intended to be within the scope of the disclosed subject matter. Other novel and nonobvious features will become apparent from the following detailed disclosure when considered in conjunction with the figures and are also within the scope of the disclosure.

BRIEF DESCRIPTION OF THE FIGURES

The detailed description is described with reference to the accompanying figures. In the figures, the left-most digit(s) of a reference number usually corresponds to the figure in which the reference number first appears. The use of the same reference numbers in different figures usually indicates similar or identical items.

DETAILED DESCRIPTION

This document discloses systems, apparatus, methods, etc. for displaying artwork and more specifically for displaying artwork in environments wherein the artwork might be subject to shock, thermal extremes, mishandling, etc.

Figure 1:
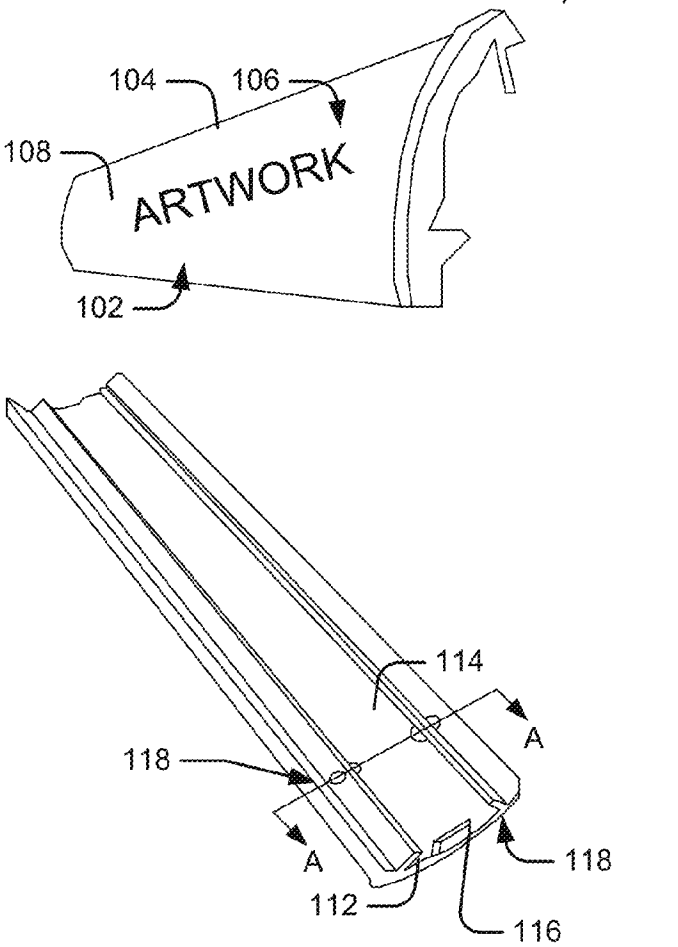
FIG. 1 illustrates an artwork frame.

FIG. 1 illustrates an artwork frame. More specifically, FIG. 1 illustrates an artwork frame 100, artwork 102, a frame body 104, a display area 106, an exterior surface 108, a rail engagement portion 110, ridges 112, an interior surface 114, a stop 116, and tool apertures 118. In the current embodiment, the artwork frame 100 holds or defines the artwork 102. That artwork 102 can be selected by the user and can be three-dimensional in nature. For instance, the artwork 102 can be an engraved piece of artwork, an embossed piece of artwork, artwork defined by stamping, punching, etching, etc. or some other type of three-dimensional artwork.

The frame body 104 of the current embodiment is elongated in a direction generally parallel to its longitudinal axis x. Moreover, it defines an arc-shaped cross-section when viewed in a direction more or less parallel to the longitudinal axis x. Thus, the artwork 102 is displayed on the curve-linear display area 106 and (in general) shares that curve-linear shape. The curve-linear presentation of the artwork 102 can make it appear more prominently and/or give the artwork 102 a "bolder" appearance than might otherwise be the case. If desired, that curve-linear display area could also/instead include one or more flat, linear, and/or angled surfaces. With regard to the frame body 104, it can define the exterior surface 108 of which the display area 106 can be a portion thereof. Moreover, it can also generally reflect the arc-shaped cross-section and can be made of any of a number of materials. For instance, the frame body 104 can be made of nylon, acrylonitrile butadiene styrene (ABS) plastic, cast iron, brass, bronze, aluminum, titanium, etc.

The rail engagement portion 110 of the current embodiment couples to the frame body 104 and, if desired, can be formed integrally therewith. Moreover, the rail engagement portion 110 can include or define one or more of the ridges 112. These ridges 112 can serve to mount and/or removably attach the artwork frame 100 to a tactical rail on an object or surface on which a user might wish to display the artwork 102. Note that the tactical rail need not be on any particular object to be within the scope of the current disclosure. For instance, it can be mounted to a weapon. However, suitable tactical rails and/or other mounting hardware could be affixed to a surface such as a wall in a museum without departing from the scope of the current disclosure.

Still with reference to FIG. 1, the ridges 112 point generally inwardly from the interior surface 114 although there may be fairly significant departures from an "inward" direction so long as the ridges 112 point in a direction allowing them to engage the tactical rails (disclosed further elsewhere herein). Furthermore, so long as the rail engagement portion 110 can engage the tactical rails of (for instance) a weapon, the ridges can be any shape and might not be true "ridges". Rather, the ridges could be a one or more spaced apart posts or other structures that, together, act as a ridge by engaging tactical rails sufficiently to attach the artwork frame 100 thereto.

With continuing reference to FIG. 1, the artwork frame 100 of the current embodiment also defines features that can be used to secure the artwork 102 to the objects, surfaces, etc. to which users might want to mount the artwork 102. For instance, the rail engagement portion 110 can define a stop 116 which (in the current embodiment) is a raised portion of the interior surface 114. It can be adapted to engage a slot associated with the tactical rails. In addition, or in the alternative, the artwork frame 100 can define tool apertures 118 adapted to accept various weapons tools (disclosed further elsewhere herein). The tool apertures 118 can penetrate a portion of the frame body 104, the display area 106, the exterior and interior surfaces 108 and 114, the rail engagement portion 110, the ridges 112, etc. Further, the tool apertures 118 can accept weapon tools and by engaging therewith can secure the artwork frame 100 to a surface, object, etc.

Figure 2:
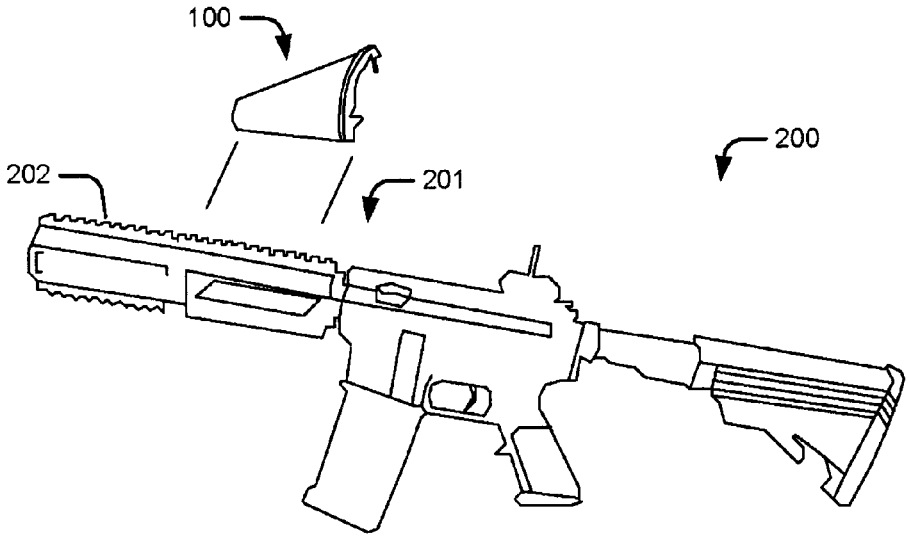
FIG. 2 illustrates an object on which the artwork frame of FIG. 1 can be mounted.

FIG. 2 illustrates an object on which the artwork frame of FIG. 1 can be mounted. More specifically, the object (in the current embodiment) happens to be a weapon 200 but could be any object with a tactical rail or similar structure. For instance, some rails on such objects could comprise separate, spaced apart posts or other structures that can serve as rails. The weapon 200 of the current embodiment could be any type of weapon such as a rifle, shotgun, automatic weapon, semi-automatic weapon, etc. (AR-15s, AK-47s, M-16s, etc.). Many such weapons 200 include Picatinny rails, MIL-STD-1913 rails, STANAG 2324 rails, and/or other brackets or hardware for attaching accessories to the weapon 200. All such tactical rails 201 are thus within the scope of the current disclosure. Tactical "rails" 201 usually include one or more grooves 202 on each side of the weapon 200 and a plurality of slots 204 on the top of the tactical rails 201. Moreover, tactical rails 201 come in a variety of lengths and can be positioned at many differing locations on weapons 200.

FIG. 2 also shows that some artwork frames 100 can slide onto or otherwise attach to the tactical rail 201 by way of the ridges 112. These ridges 112 correspond in shape and size to the grooves 202 of the tactical rail 201. In addition, or in the alternative, the stop 116 corresponds in size and shape to the slots 204. Thus, when the ridges 112 are engaged with the grooves 202, the stop 116 can engage one of the slots 204 thereby preventing (or limiting) relative motion along the longitudinal axes x between the artwork frame 100 and the weapon 200.

In some embodiments, the tool apertures 118 also have a role in limiting relative motion between the artwork frame 100 and the weapon 200. More specifically, the tool apertures 118 can be spaced apart from the stop 116 and/or each other by about the same distance as exists between slots 204 of many tactical rails 201. Moreover, the tool apertures 118 form corresponding passages from one side of the artwork frame 100 to the other. Those passages extend through one side of the frame body 104 (near its edge), thence through the adjacent ridge 112, and then through the other ridge 112 and then the other side of the frame body 104 (near its opposite edge). The apertures can correspond in diameter to the diameter of various weapons tools so that one (or more) of these weapons tools can be inserted through the tool apertures 118. Moreover, the weapon tools and tool apertures 118 can form an interference fit there between so as to help retain the weapon tools in the tool apertures 118. As a result, when the artwork frame 100 is coupled to the weapon 200, the weapons tool(s) will pass through one of the slots 204 of the tactical rail 201 and help secure the artwork frame 100 to the weapon 200. The tool apertures 118 therefore also provide a convenient location to store such weapons tools. And, if desired, certain tool apertures 118 can be adapted to hold two or more weapon tools.

With continuing reference to FIG. 2, the artwork frame 100 of the current embodiment can be configured to be a hand guard for various weapons 200 and/or other objects to which the artwork frame 100 might removably attach. More specifically, the artwork frame 100 can be made of nylon, aluminum, etc. or some other material capable of withstanding the temperatures and the repeated shocks likely to be experienced while it is mounted on a weapon 200. In addition, the artwork frame 100 of the current embodiment possesses sufficient rigidity to withstand such shocks and/or other environmental and/or handling factors without deforming enough that the frame body 104 might contact the weapon barrel or other hot surfaces of the weapon 200. This might be desired because the temperature at the end of some automatic weapons can reach hundreds of degrees Fahrenheit which would degrade or destroy much heretofore-available artwork. As to the shock and/or vibration possible in some environs, Table 1 lists some data illustrative of the shocks associated with firing various weapons. Artwork frames 100 of embodiments are made of materials and/or are configured so as to survive in such environments although less rigid artwork frames 100 are within the scope of the current disclosure.

TABLE 1

Typical Weapon-Related Shock Data

| Gun Type | Recoil Force (ft-lbs) |
|---|---|
| .223 Rifle (M-16) | 3.2 |
| .308 Rifle (M-14) | 15.8 |
| 12 Gauge Shotgun | 45 |
| .458 Elephant Gun | 62.3 |

The artwork frame illustrated by FIG. 2 happens to arc through about 30 degrees and has a width of about 1.5 inches. It's radius of curvature is thus about 2 inches. particular artwork frame 100, therefore, covers the upper surface of many weapons 200 although other configurations are within the scope of the current disclosure. For instance, the artwork frame 100 could arc, turn, bend, etc. to cover the sides of the weapon 200 or could extend in a circle (or otherwise enclosing shape) to fully or partially envelop the weapon. Its radius of curvature could also be reduced (increased) to make for a more compact (larger) frame if desired. Thus, its size can be tailored to the environment in which it might be used and/or the size of the artwork 102 desired to be displayed thereon. If the artwork 102 might be displayed in a brushy area, for instance, its size can be reduced. If, though, the artwork 102 is to be displayed in an indoor (or snag-free) environment such as museum or restaurant, its size could be increased. FIG. 2 illustrates that the artwork frame 100 of the current embodiment is about 6 inches in length and thus only covers a portion of many weapons 200 and/or many tactical rails 201. However, it could extend further (or a lesser distance) along the longitudinal axis x so that it coves more (or less) of the weapon 200. Its width could also be increased or decreased as desired without departing from the scope of the current disclosure. It might also be worth noting that while certain directionally oriented terms (such as up, down, width, length, interior, exterior, etc.) are used herein, their use is for the sake of convenience and does not limit artwork frames of the current disclosure to any particular orientation, position, etc.

Figure 3:
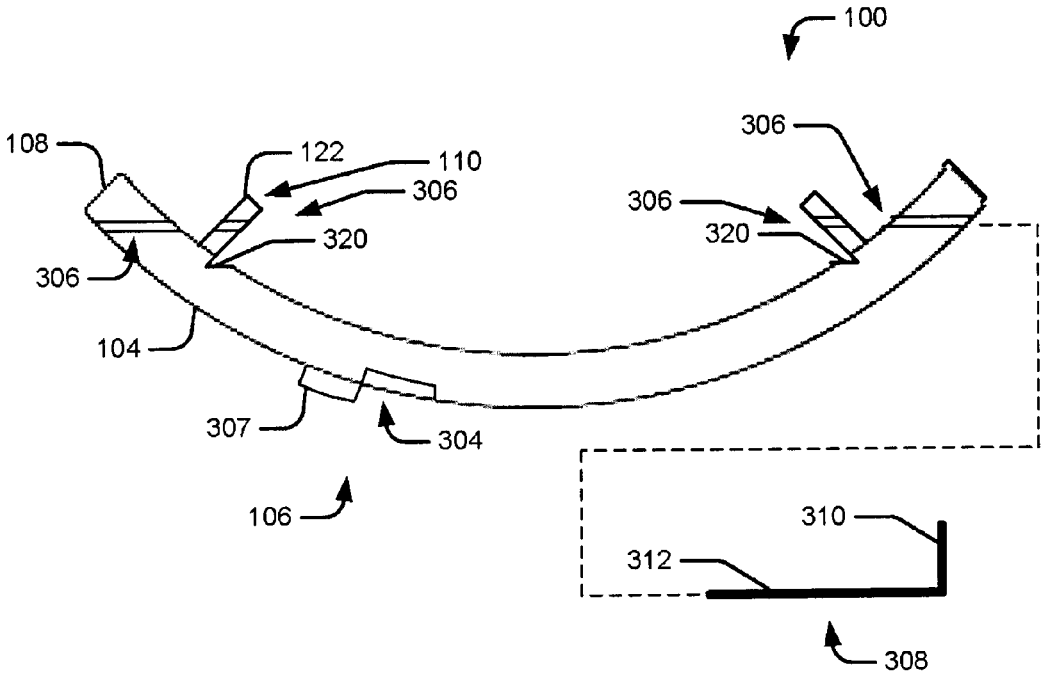
FIG. 3 illustrates a cross-sectional view of an artwork frame taken along line AA in FIG. 1.

FIG. 3 illustrates a cross-sectional view of an artwork frame taken along line AA in FIG. 1. More specifically, FIG. 3 illustrates a thinned section 304 of the frame body 104, tool apertures 306, a weapons tool 308, and a more or less V-shaped structure 309. The artwork 102 can define the thinned section 304 and, for that matter, sections that are not thinned (or sections 307 that are thicker than other sections of the frame body 104). For instance, if the artwork 102 is an engraving or some other structure formed by removing material from the frame body 104, then the artwork 102 does define a thinned area 304. Of course, if the artwork 102 is formed by adding material to the frame body (as with embossing), then the artwork 102 defines a thickened section 307 of the frame body 104.

Furthermore, FIG. 3 illustrates a particular weapons tool 308. This particular weapons tool 308 happens to be a hex wrench although many other tools are within the scope of the current disclosure. And, indeed, many weapons tools 308 include a handle 310 and a shank 312. The latter being one of the portions of the weapons tool 308 that can slide and/or plug into the weapons tools apertures 116 as disclosed further elsewhere herein.

FIG. 3 also illustrates that the interior surface 114 can define a pair of flats 320 adjacent to the ridges 112. These flats 320 can be positioned and angled such that they ride against corresponding surfaces on the tactical rails 201. They can also be roughened or coated with a material having a relatively high coefficient of friction (when slid over typical tactical rail 201 materials such as gun metal). Thus, these flats 320 can increase the amount of friction and/or stiction between the artwork frame 100 and the tactical rail 201 thereby aiding in holding the two objects in fixed relationship to one another. With reference still to FIG. 3, it might be interesting to note that the outer edges of the frame body 104 and the ridges 112 form the V-shaped structures 309 with the flats 320 further accentuating this feature of the current embodiment.

Figure 4:
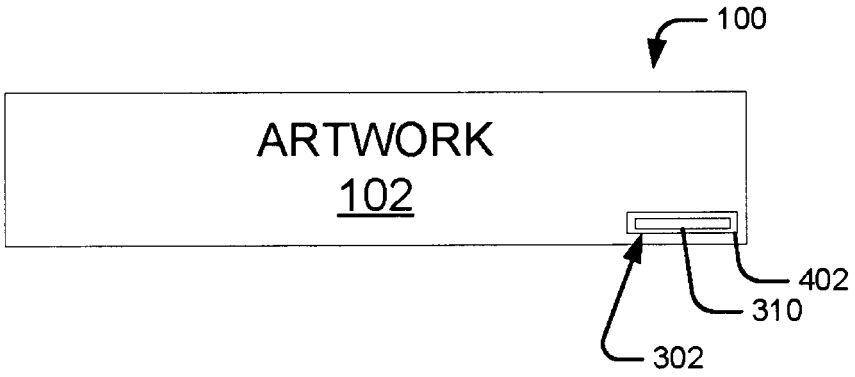
FIG. 4 illustrates a side-view of an artwork frame.

FIG. 4 illustrates a side-view of an artwork frame. More specifically, FIG. 4 illustrates a recess 402 in the frame body 104 into which the handle 310 of the weapons tool 308 can fit. Thus, the weapons tool 308, when in the tool apertures 118 can rest more or less flush against the artwork frame 100 yielding little if anything to visually draw attention away from the artwork 102. The recess 402 can also reduce or prevent the user's hand (or other objects in the environment) from accidentally snagging the tool.

Figure 5:
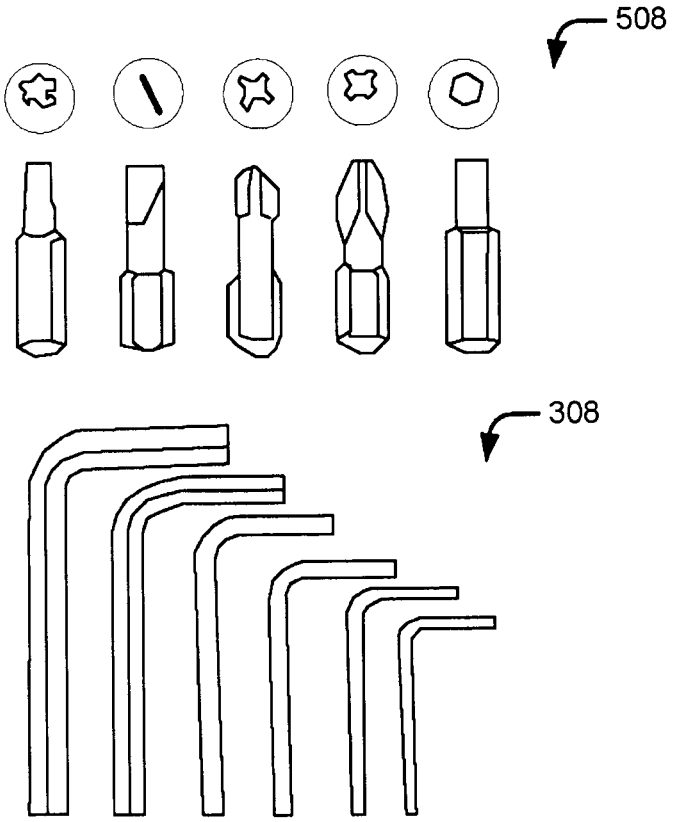
FIG. 5 illustrates a set of weapons tools.

FIG. 5 illustrates a set of weapons tools. Such sets of weapons tools 308 and 508 can include (but are not limited to): a Phillips head drill bit, a flat screw head drill bit, a file, punches (both 3/32" and 5/32") a hex driver, a stainless pointed knife, and/or a magnesium rod (for camping). These weapon tools 308 and 508, while probably an incomplete set, provide a gun user enough capability that the user can fix, adjust, maintain, etc. most weapons in the field with them. Accordingly, in some embodiments, artwork frames provide tool apertures for the foregoing weapon tools and 508 and/or other tools.

Figure 6:
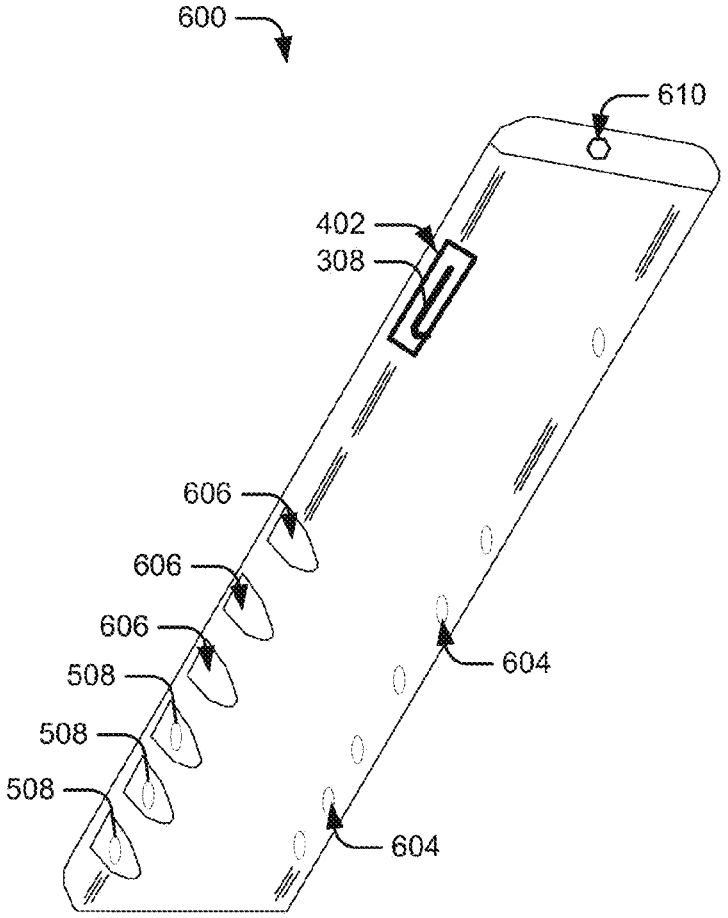
FIG. 6 illustrates a perspective view of another artwork frame.

FIG. 6 illustrates a perspective view of another artwork frame. More specifically, FIG. 6 illustrates an artwork frame 600 for holding a set of weapons tools 308 and 508. FIG. 6 therefore also illustrates a plurality of tool apertures 606 each of which can be tailored in size and shape to accommodate various weapons tools 308 and 508. The tool apertures 606 can be spaced apart so that the weapons tools 308 and 508 can engage respective slots 204 in typical tactical rails 201. Thus, the weapons tools 308 and 508 help secure the artwork frame 600 to the tactical rails. The slots 204 of the tactical rails (or rather their walls) can help retain the weapons tools 308 and 508 in their respective tool apertures 606 in some embodiments. Note that the tool apertures 606 are generally closed at one end. Yet, corresponding and relatively small tool apertures 606 can allow certain smaller weapons tools 308 to penetrate the entire artwork frame 600.

Figure 11:
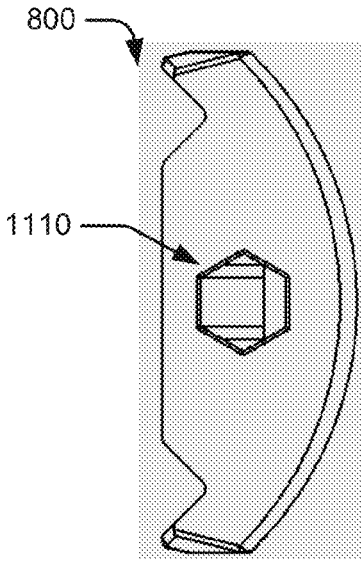
FIG. 11 illustrates another side elevation view of an artwork frame.

FIG. 6 also illustrates tool adaptor 610. The tool adaptor 610 allows a user to insert a tool into the tool adapter 610 and to use the artwork frame 600 as a screwdriver or wrench and/or a "cheater bar" for the various tools. For instance, the tool adapter 610 can be hexagonal in shape so that a hex wrench or Allen wrench can be inserted therein. The user can then grip the artwork frame 600 by the opposite end to gain mechanical advantage for turning the tool (and/or fasteners upon which it might be applied). Such tool adapters 610 can be located on the stops and/or other surfaces of artwork frames of various embodiments. Note that FIGS. 11 and 12 also illustrates certain tool adapters 1110 and 1210.

Figure 7:
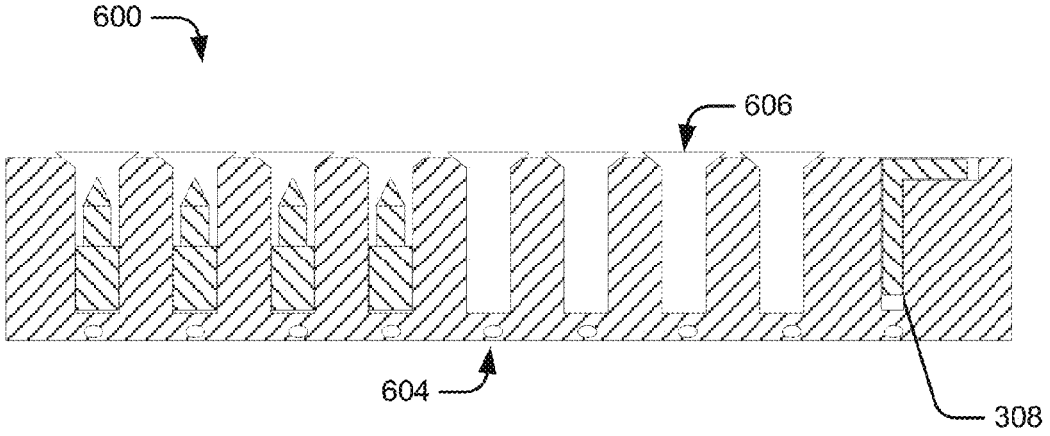
FIG. 7 illustrates a cross section of an artwork frame.
Figure 8:
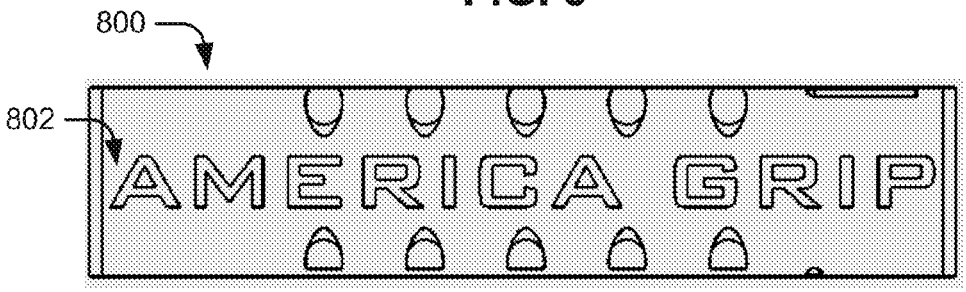
FIG. 8 illustrates a top plan view of an artwork frame.
Figure 9:
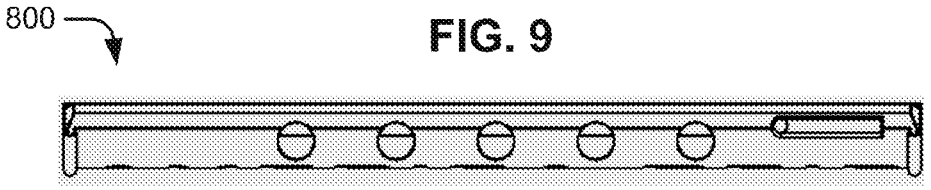
FIG. 9 illustrates a side elevation view of an artwork frame.
Figure 10:
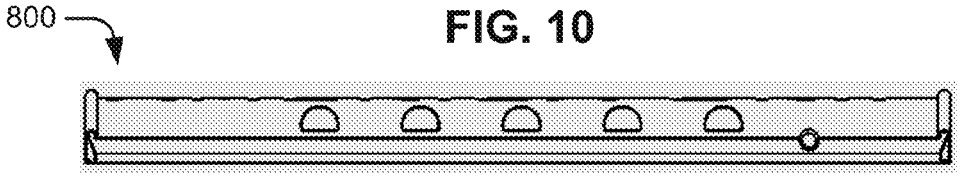
FIG. 10 illustrates a side elevation view of an artwork frame.

FIG. 7 illustrates a cross section of an artwork frame. More specifically, FIG. 7 shows various tool apertures 606 holding various weapons tools 508. Of course, if desired, one or more of the tool apertures 606 could be configured to hold a weapons tool 308.

FIGS. 8-14. Illustrate various views of an artwork frame. More specifically, FIGS. 8-14 illustrate a top plan view, three side elevation views (as seen from both sides and an end of the artwork frame 800), a bottom plan view, and two perspective views (as seen from general above and below) of the artwork frame 800 of embodiments. Thus, FIGS. 8-14 illustrate the ornamental appearance of an artwork frame 800 of the current embodiment. Note though that the particular artwork 802 displayed thereon is merely illustrative and in no way limits the scope of the current disclosure.

Figure 12:
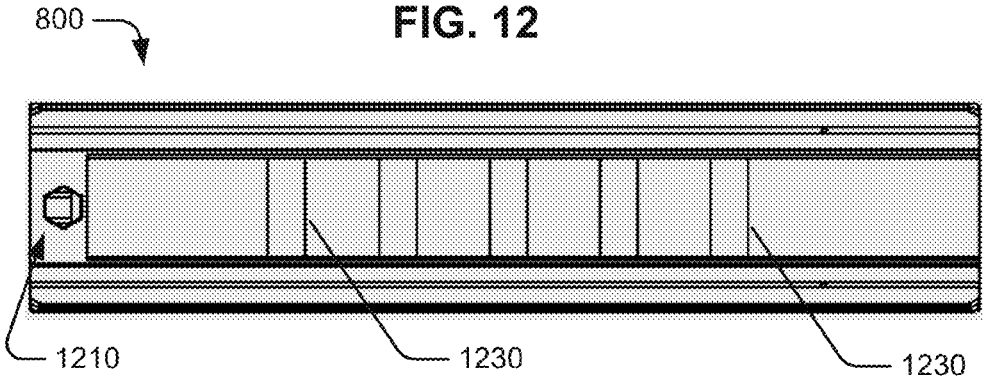
FIG. 12 illustrates a bottom plan view of an artwork frame.
Figure 13:
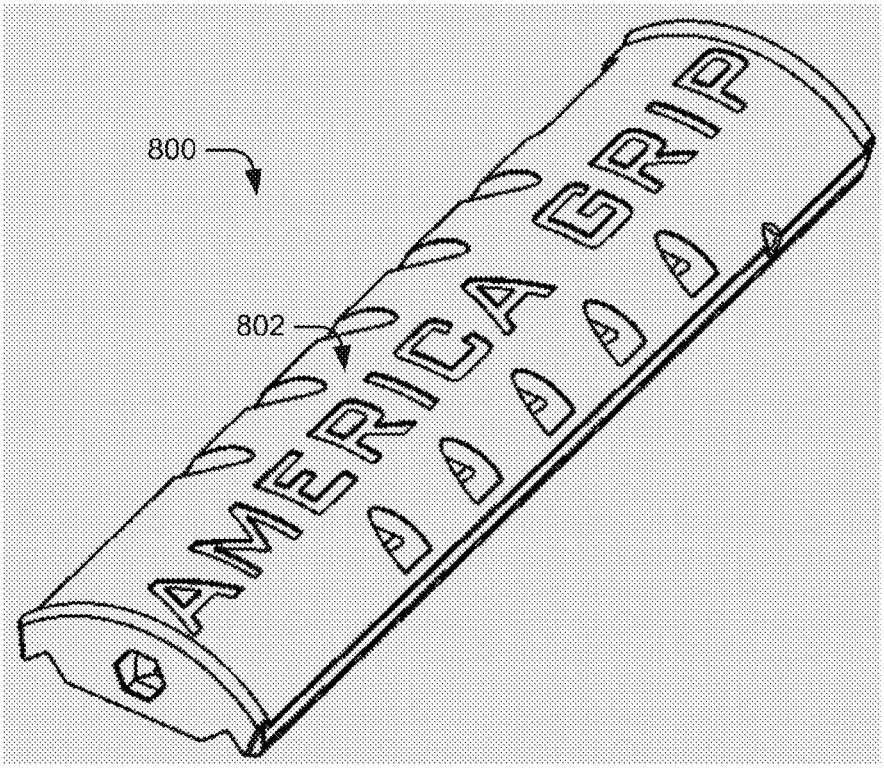
FIG. 13 illustrates a perspective view of an artwork frame as viewed generally facing an exterior surface thereof.
Figure 14:
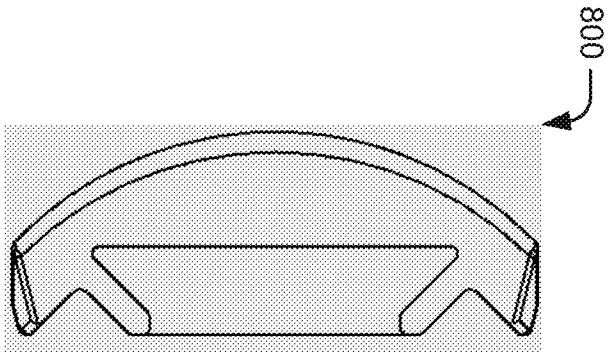
FIG. 14 illustrates another side elevation view of an artwork frame.

FIG. 12, as noted elsewhere herein, illustrates a bottom plan view of an artwork from of embodiments. The artwork frame 1200 includes ridges 1230 spaced apart and/or otherwise shaped and dimensioned to mate with the grooves on various Picatinny rails. Thus, the ridges 1230 can aid in securing the artwork frame 1200 to objects with Picatinny rails such as automatic weapons.

Figure 15:
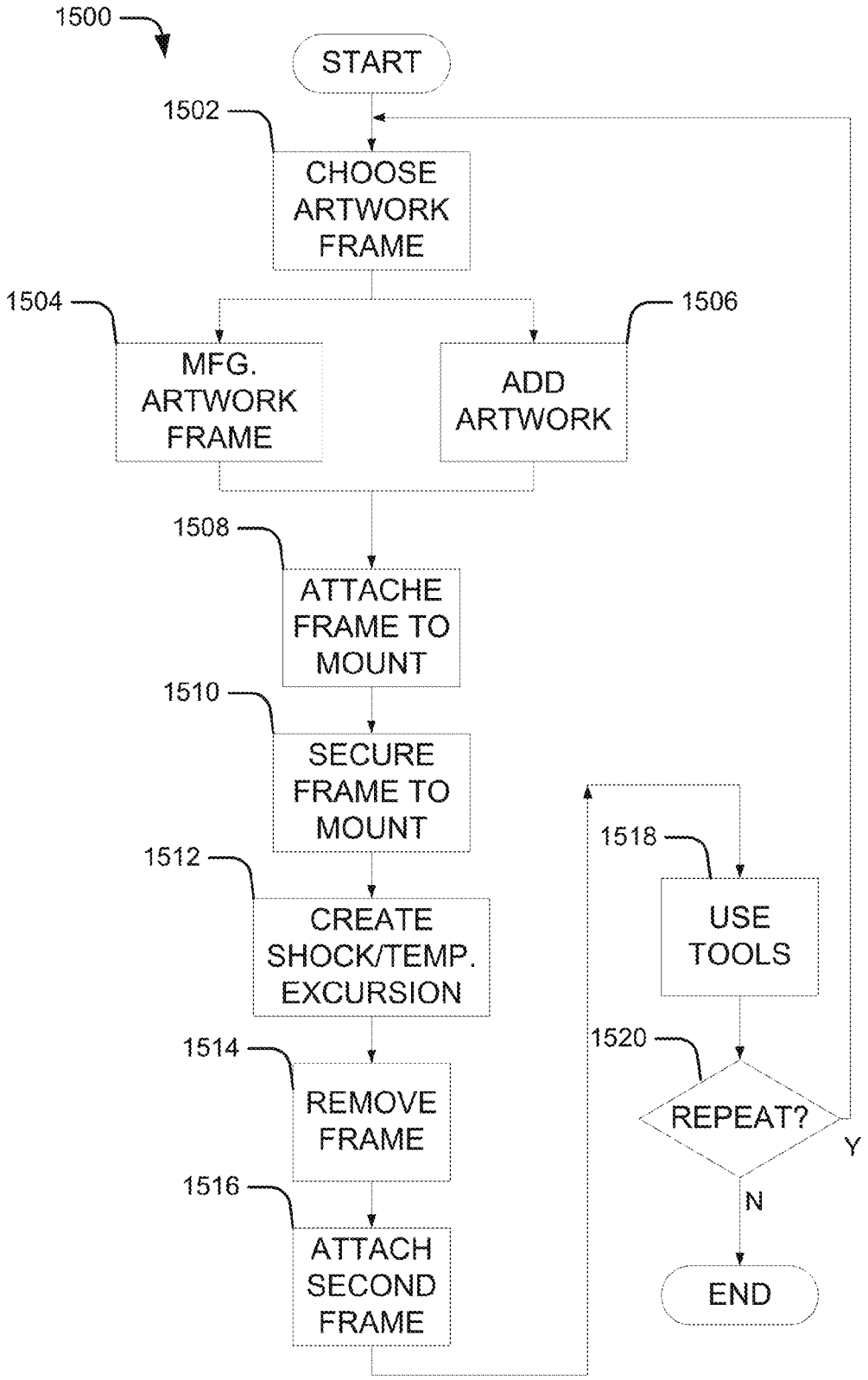
FIG. 15 illustrates a flowchart of a method of manufacturing artwork frames.

FIG. 15 illustrates a flowchart of a method of manufacturing artwork frames. More specifically, FIG. 15 illustrates method 1500 which can begin with a user selecting the type of artwork frame 100 which they are interested in manufacturing and/or having manufactured. For instance, the user can select the size (length, width, radius of curvature, etc.) of the artwork frame 100. Moreover, the user can select the type of tactical rail 201 onto which the artwork frame can attach. Accordingly, the type of rail engagement portion 110 can be decided upon based on such a selection. Further, still, the user can select the material type and/or color of the artwork frame 100. For instance, if the user is interested in having the artwork frame 100 used with an AR (colloquially, an "automatic rifle") with a Picatinny rail, the user can select an artwork frame 100 of an appropriate size which is outfitted with ridges 112 corresponding in shape, size, spacing, etc. corresponding to it. See reference 1502.

At reference 1504, method 1500 includes manufacturing the artwork frame 100 as selected by the user. For instance, if the artwork frame 100 is to be made of a polymer or other plastic or plastic-like material, then a mold can be made for it and the part can be molded from the material. In the alternative, if the selected material can be extruded, then a die manufacturing system can be set up and the part extruded. Of course, in either situation, the parts can be cut, trimmed, de-burred, etc. during/after their manufacture. Additionally, the part can be painted after the fact or pigments can be added to the raw material (before molding) to yield an artwork frame of the selected color.

Depending on how the artwork 102 is to be added to the artwork frame 100, the artwork 102 can be added during the manufacturer of the artwork frame 100 or afterwards. See reference 1506. For instance, if the artwork 102 is to take the form of an engraving, then the artwork frame can be placed in a jig and engraved with the artwork 102. In addition, or in the alternative, the artwork 102 can be added to the artwork frame 100 by some form of embossing. Or, if desired, the artwork 102 can be added to the frame by stamping the frame in a die.

No matter how the artwork 102 is added to the artwork frame 100, the artwork frame 100 can be attached to a mount or rail corresponding in design to the rail (or other mount) selected for the artwork frame 100 as shown at reference 1508. For instance, in scenarios involving Picattiny rails, the rail engagement portion 110 can be aligned with the Picatinny rails of the object on which the artwork 102 will be displayed and slid thereon. Furthermore, the sliding engagement between the rail engagement portion 110 and the rail can continue until the stop 116 reaches a slot in the Picattiny rail. Furthermore, method 1500 can include securing the artwork frame 100 to its mount. More specifically, one or more weapons tool 308 and/or 508 can be slid into the weapons tools apertures 118 so that the weapons tool 308 and/or 508 engages a slot of the mount. Thus, the weapons tool 308 and/or 508 can help hold the artwork frame 100 in a fixed relationship with its mount. See reference 1510.

Of course, some mounts for the artwork frame 100 (such as those on a weapon 200) might expose the artwork frame 100 to shock. For instance, if the artwork frame 100 is mounted to an AR then the repeated firing of the weapon 200 will cause shocks to be transmitted from the barrel of the weapon 200, through the tactical rail 201, and thence to the artwork frame 100 whether reduced in magnitude or not. The hot exhaust gases within the barrel of the weapon 200 might heat the barrel causing the tactical rail to warm too at least to some degree. In turn, that warming can cause the ridges 112 of the rail engagement portion 110 to also heat up. Thus, a portion of the artwork frame 100 can be exposed to such shock and/or temperature excursions. But, again, if it is desired to use the artwork frame 100 in such environments, its materials of construction and/or other aspects of its configuration can be selected so that it is sufficiently rugged to survive therein. See reference 1512.

At some point the user might desire to change the artwork 102 displayed on the mount. For instance, a gun owner might want to display a different piece of artwork 102 at a gun show than they might want to display at a shooting range or out in the field, forest, jungle, etc. Of course, many other scenarios could create a desire to change the artwork 102. Thus, the user can detach or remove the artwork frame 100 from its mount as illustrated by reference 1514. Another artwork frame 100 with differing artwork 102 can be attached to the mount in accordance with the user's desires. See reference 1516.

Furthermore, the artwork frames 100 of embodiments do allow the user to store weapons tools 308 and/or 508 in the tool apertures 118. As a result, it is possible that a user might wish to use one or more of these tools. To do so, the user can select the tool and free it from its tool aperture 118. The user could then use the tool to, for instance, maintain a weapon 200. When the user no longer desires to use the tool, the user can re-insert it into the tool aperture 118 thereby returning it to storage. See reference 1518. Of course, since artwork frames 100 of embodiments provide for storage of the weapons tools 308 and/or 508, the user need not carry these weapons tools 308 and/or 508 separately or even carry a bag or other container for them thereby easing logistical considerations which might need to be accommodated.

Of course, method 1500 can be repeated in whole or in part as indicated at reference 1520. If the user does wish to repeat a portion of method 1500, FIG. 15 indicates that the user can begin method 1500 again (perhaps omitting some portions thereof). Otherwise, FIG. 15 shows that the method 1500 can end.

Figure 16:
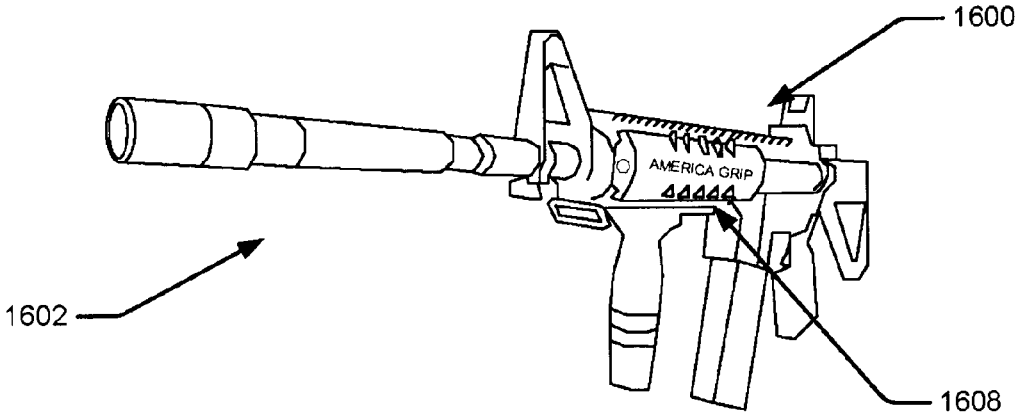
FIG. 16 is a photograph of an artwork frame mounted on an object.
Figure 17:
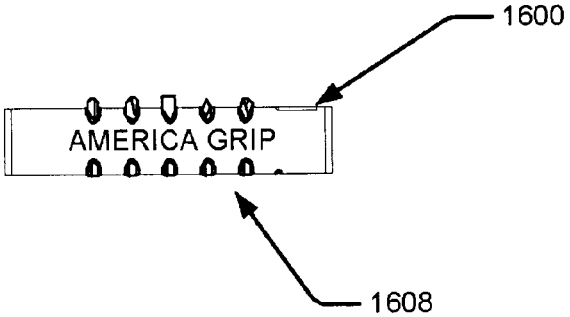
FIG. 17 is a photograph of an artwork frame.
Figure 18:
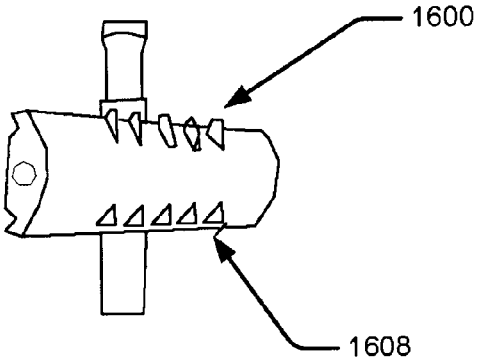
FIG. 18 is another photograph of an artwork frame.
Figure 19:
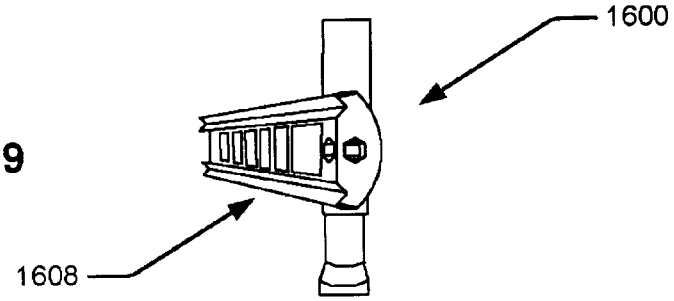
FIG. 19 is yet another photograph of an artwork frame.

With reference now to FIGS. 16-19, these figures are photographs of an artwork frame 1600. More specifically, the artwork frame 1600 is shown in FIG. 16 being mounted to an object 1602 (here an automatic weapon). It is also shown, holding a set of tools 1608 which individually and/or in combination secure the artwork frame 1600 to the object 1600 (when mounted thereon). FIGS. 16-19 also illustrate the ornamental appearance of the artwork frame 1600 of the current embodiment. Although, the particular artwork displayed thereon (the term "America Grip") does not limit the scope of the current disclosure. For instance, the artwork could be graphical in nature.

As FIGS. 1-19 and the disclosure herein illustrate, embodiments provide ruggedized artwork frames and/or artwork frames which can be mounted on tactical rails and/or other structures. Moreover, the curve-linear display areas of embodiments can cause the artwork displayed therein to assume a more prominent appearance than it would otherwise assume on a flat display area. The three dimensional nature of some artwork can further enhance the visual appearance of that artwork. Additionally, some embodiments provide art-decorated hand guards for weapons of various sorts. Some artwork frames disclosed herein can be removable attached to their mounts and can be secured thereto using weapons tools as lynchpins, cotter pins, etc. to secure the artwork to the structures on which they are mounted. Embodiments also provide methods of manufacturing artwork frames and hand guards and methods for displaying artwork on weapons.

Figure 20:
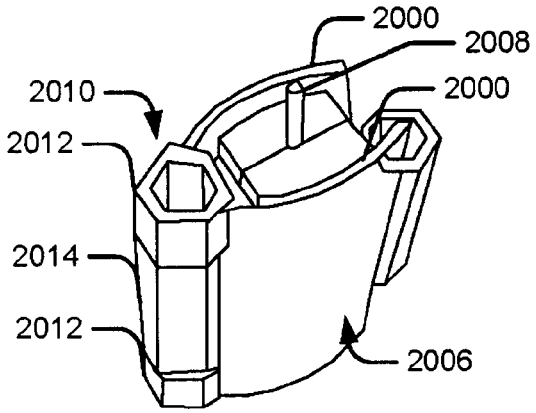
FIG. 20 illustrates a perspective view of a pair of interlocked artwork frames.

FIG. 20 illustrates a perspective view of a pair of interlocked artwork frames. More specifically, FIG. 20 illustrates a pair of artwork frames 2000, corresponding frame bodies 2004, display areas 2006, a weapons tool 2008, and a pair of couplings 2010, corresponding female coupling halves 2012, and corresponding male coupling halves 2014.

FIG. 20 also shows that the pair of interlocked artwork frames 2000 holds a weapons tool 2008 there between. Thus, a user can grasp the interlocked artwork frames 2000, position the weapons tool 2008 on an appropriate piece of a weapon, and work the weapon with the weapons tool 2008. Since the interlocked artwork frames 2000 present a generally rounded object to the user and since they are an appropriate size in the current embodiment (from an ergonomics perspective), they provide the user sufficient mechanical advantage to do so while also being comfortable to hold/manipulate. Yet, as is disclosed further herein, the user can release the interlocked artwork frames 2000 from each other and/or replace the weapons tool 2008 with another weapons tool 2008. Indeed, the couplings 2010 enable such capabilities in that they allow the two artwork frames 2000 to be releasably coupled, attached, etc, to each other while other features (provided by the current embodiment) hold the weapons tool 2008 securely in between the artwork frames 2000.

Figure 21:
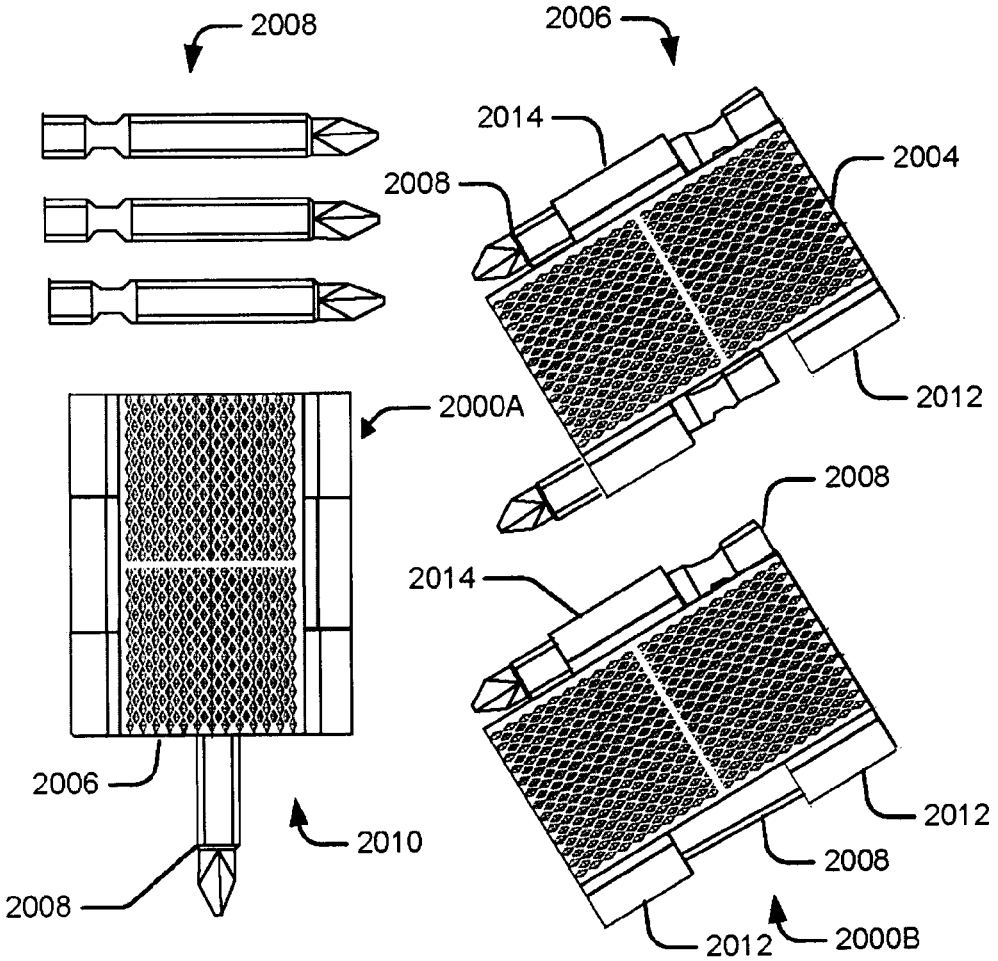
FIG. 21 illustrates a top plan view of several artwork frames.

FIG. 21 illustrates a top plan view of several artwork frames. The artwork frames 2000 of the current embodiment can provide ample storage for various weapons tools. One of the artwork frames 2000A) is shown holding a weapons tool 2008 at one of the ends of the pair of interlocked artwork frames 2000A. Of course, in the current embodiment, the weapons tool 2008 could be held at the other end of the interlocked artwork frames 2000. Another artwork frame 2000B illustrates that it, acting alone, can hold a weapons tool 2008 by either the female coupling half 2012, the male coupling half 2014, or both. Another artwork frame 2000C illustrates that any one of the coupling halves 2012 or 2014 can hold a weapons tool 2008 without the weapons tool 2008 interacting with other coupling halves 2012 or 2014. Furthermore, FIG. 21 shows that one weapons tool 2008 extends from one of the female coupling halves 2012 of artwork frame 2000C far enough in a longitudinal direction such that it could engage (and/or be held by) another coupling half. In the current embodiment, therefore, the weapons tool 2008 could contribute to holding two or more artwork frames 2000C in (temporarily or permanently) fixed relationship with one another.

Figure 22:
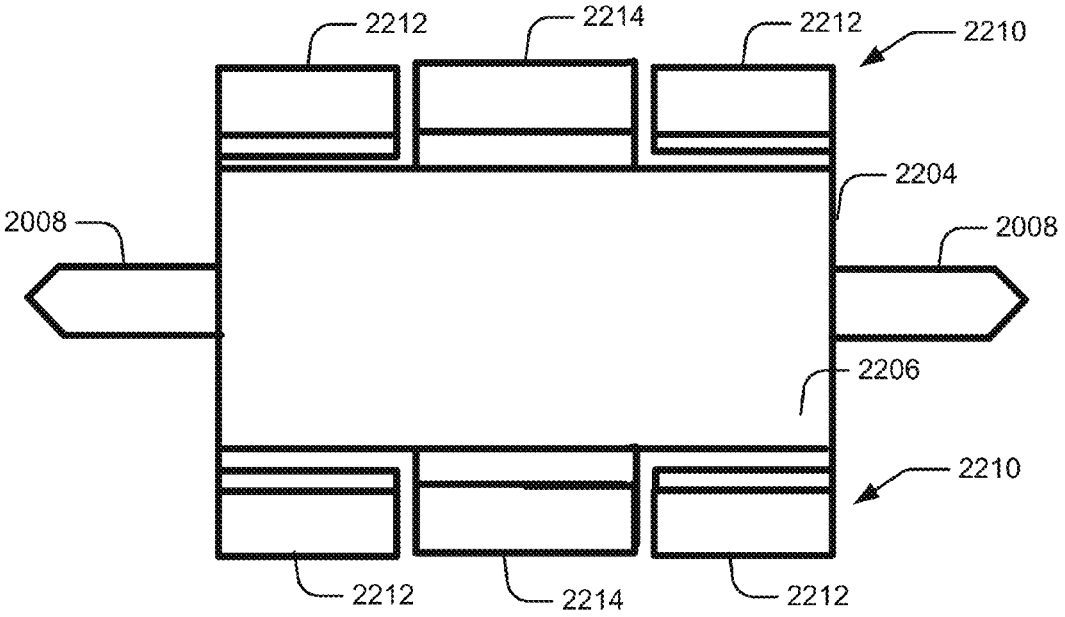
FIG. 22 illustrates a top plan view of a pair of artwork frames.

FIG. 22 illustrates a top plan view of a pair of artwork frames. More specifically, FIG. 22 illustrates that two interlocking artwork frames 2000 can hold weapons tools 2008 at both ends while allowing them to extend from between the artwork frames 2000. Thus, the current embodiment provides a dual purpose tool with which users can service their weapons, related paraphernalia, and/or other objects.

FIG. 22 also illustrates the female and male coupling halves 2212 and 2214 on both sides of the pair of artwork frames 2200. Note that one artwork frame is largely visible in FIG. 22 with its male coupling half 2214 also being visible on the right side of FIG. 22 and its female coupling halves 2212 being visible on the left side of FIG. 22. The opposite can be said of the other (largely hidden) artwork frame 2200. Thus, artwork frames 2200 of the current embodiment can possess complimentary coupling halves 2212 and 2214 such that any artwork frame 2200 can mate with any other artwork frame 2200 of the current embodiment. It might also be helpful to note that such complimentary coupling halves 2212 and 2214 can be shaped and dimensioned to possess there between a slight interference fit. That interference fit can be designed such that human users can easily mate/de-mate the coupling halves 2212 and 2214 while providing sufficient friction to withstand relative movement between the artwork frames 2200 despite the firing of a weapon on which they might be mounted. With reference now to FIGS. 23-26, and at this juncture, it might now be helpful to consider some features of the artwork frames 2200 which allow the artwork frames 2200 of the current embodiment to interlock and/or hold weapons tools 2008.

FIG. 22 also illustrates that artwork frames 2200 of embodiments can include identifiers on the male coupling halves 2214. These identifiers 2226 can identify the male coupling halves 2214 so that when a user wants to de-couple a pair of coupled artwork frames 2200 (perhaps after servicing a weapon with them) they know which of the coupling halves is the male one and which are the female ones. This can facilitate de-coupling the artwork frames 2200 since it has been found that pushing on the male coupling halves 2214 tends to separate the frames more conveniently than manipulating the smaller female halves.

Moreover, FIG. 22 illustrates that the artwork displayed on frames of the current embodiment can include texturing. In the embodiment illustrated by FIG. 22, that texturing happens to have been produced by knurling although many different textures could be displayed on artwork frames 2200 of the current embodiment.

Figure 23:
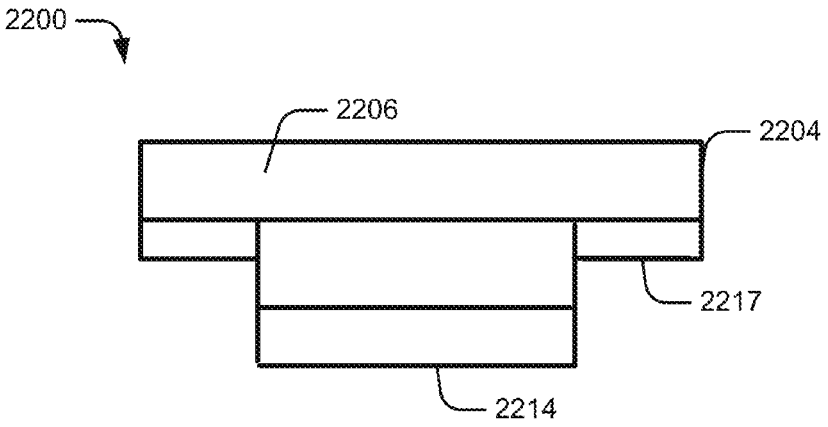
FIG. 23 illustrates a side elevation view of an artwork frame.

FIG. 23 illustrates a side elevation view of an artwork frame. More specifically, FIG. 23 illustrates an artwork frame 2200 of the current embodiment as seen looking toward one of its edges. In this view, the male coupling half 214 extending from the frame body 2004 in a direction perpendicular to the longitudinal axis of the artwork frame 2200 (and of the weapon to which it might be mounted). FIG. 23 also shows a pair of tool chucks 2317 extending from the frame body 2004 in a similar direction. Although FIG. 23 shows these tool chucks 2317 on either side of the male coupling half 214 (and spaced apart there from) this arrangement need not be the case.

Figure 24:
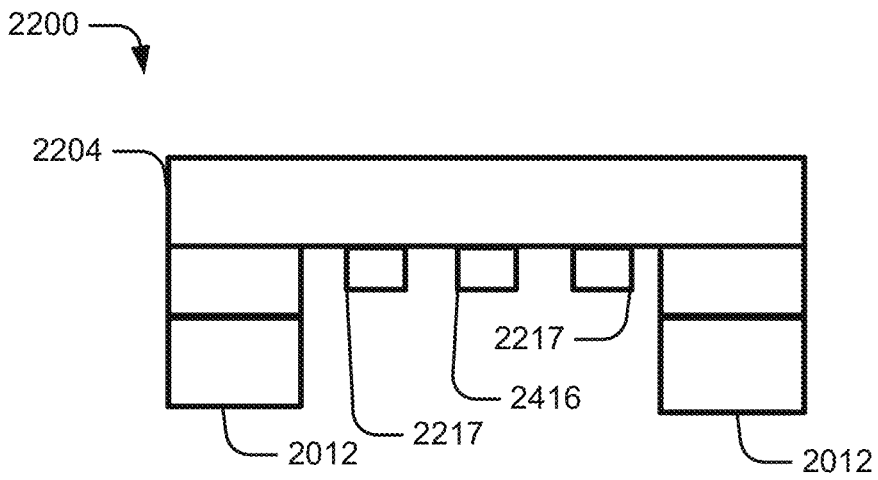
FIG. 24 illustrates another side elevation view of an artwork frame.

FIG. 24 illustrates another side elevation view of an artwork frame. Indeed, the view illustrated in FIG. 24 is seen as viewed looking toward the other edge of the artwork frame 2200 (as seen in FIG. 23). FIG. 24 therefore shows the female coupling halves 2212. In the current embodiment, the female coupling halves 2212 extend in a direction perpendicular to the longitudinal axis of the artwork frame 2200 and are spaced apart from one another longitudinally to create an interference fit with one of the male coupling halves 2014. Furthermore, FIG. 24 shows a pair of tool chucks 2317 extending from the frame body 2004 in a direction perpendicular to the longitudinal direction/axis of the frame body 2004. FIG. 24 also illustrates a stop 2416 spaced centrally on the frame body 2004 although it could be otherwise located. However, in the current embodiment, the tool chucks 2317 lie on either side of it and are located symmetrically about it. Note also that, while the tool chucks 2317 and stop 2416 extend a similar distance from the frame body 2004, the female coupling halves 2012 extend further in that direction than these features.

Figure 25:
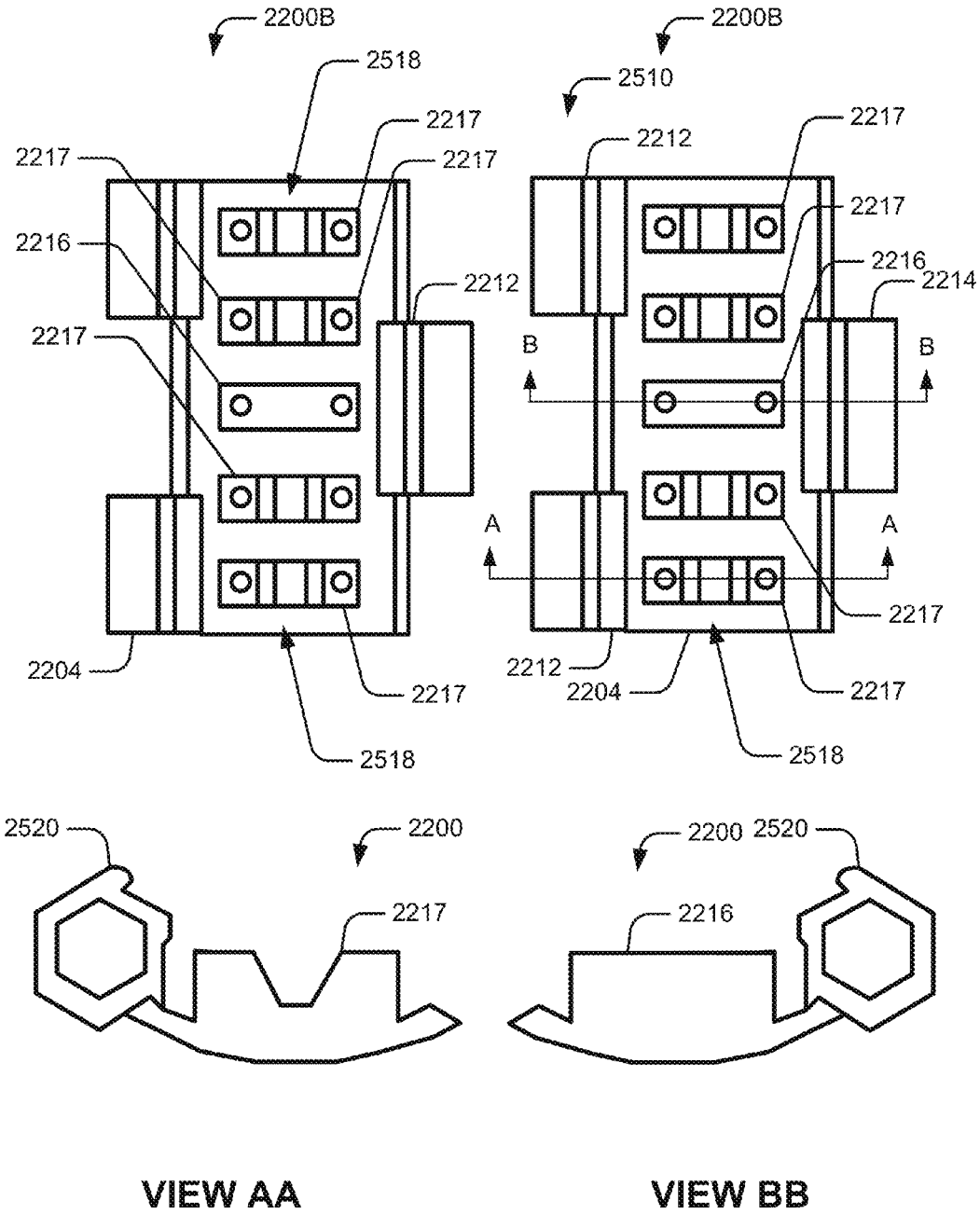
FIG. 25 illustrates a bottom plan view of a pair of artwork frames.
Figure 26:
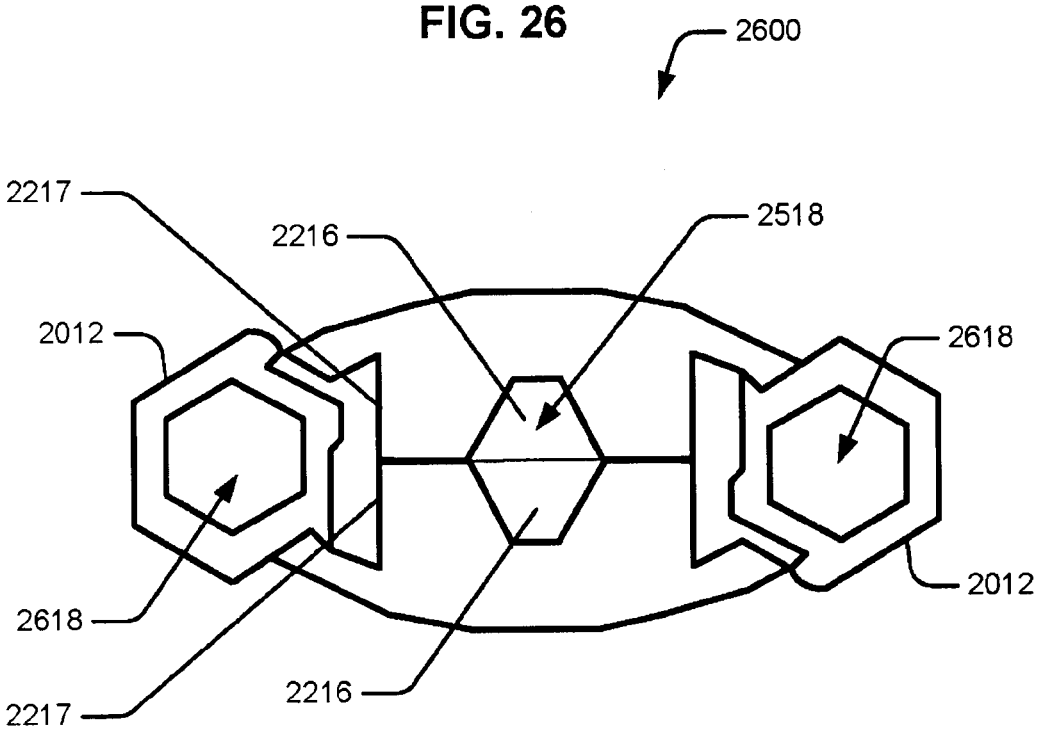
FIG. 26 illustrates an end view of yet another artwork frame.

FIG. 25 illustrates a bottom plan view of a pair of artwork frames. Moreover, with continued reference to FIGS. 23 and 26, FIG. 25 shows how various features of the current embodiment cooperate to interlock artwork frames 2200 and to hold weapons tools 2008. For instance, FIG. 25 illustrates that the artwork frames 2200 can be registered with one another to bring the male coupling half 2214 of artwork frame 2200A in sliding contact with the female coupling halves of artwork frame 2200B along one (or the other edges thereof). The coupling halves 2212 and 2214 can then be slid into an interfering, and therefore interlocking arrangement with one another. The artwork frames 2200 can then be rotated relative to one another (and into/out of the plane of FIG. 25) such that the other coupling halves are rotated into interfering contact with one another. Thus, the artwork frames 2200A and 2200B can be brought into the configuration shown in FIG. 20. Moreover, the artwork frames 2200A and B can be separated from one another by reversing the foregoing process as well as by other processes.

FIG. 25 also shows features which are useful for holding weapons tools 2008 between interlocked artwork frames 2200 such as those shown by FIG. 20. For instance, at least some of the tool chucks 2317 define partial tool apertures 2518. These partial tool apertures 2518 can each be defined in such a way that when the artwork frames 2200 are interlocked (as shown in FIG. 20) various weapons tools 2008 can be held securely (and/or releasably) therein in accordance with the current embodiment. The stops 2216 can contribute to holding weapons tools 2008 in that they provide a "bottom" or hard-stop against which the weapons tools 2008 can abut particularly when a user is pressing a weapons tool held by the tool chucks 2217 against a work piece.

FIG. 25 also illustrates various attachment points 2518 which are defined by the tool chucks 2317 and/or stops 2416. These attachment points can be used to attach a crush pad to one of, or both of, the artwork frames 2200. Moreover, the crush pad can be tailored so as to leave the tool apertures 2518 defined by the tool chucks 2317 and/or stops 2416 open for the insertion of a weapons tool 2008 therein. Furthermore, the tool chucks 2317 and stops 2416 can be shaped, dimensions, and/or spaced apart in such a way that they can engage the grooves of many tactical rails thereby helping secure the artwork frame to a tactical rail.

FIG. 25 also shows a pair of ridges 2520 which are shaped, dimensioned, and located relative to one another such that they can engage a tactical rail. See Views AA and BB of FIG. 25. In the current embodiment, these ridges 2520 are located on the female and male coupling halves 2212 and 2216. Although, in some embodiments they could be located on either the female coupling halves 2212 or the male coupling halves 2214.

FIG. 25 also shows that some embodiments provide complimentary registration marks 2522 and 2524 on the artwork frames 2200. These registration marks 2522 and 2524 can serve to align two artwork frames 2200 when they are coupled together as shown in FIG. 20. This feature can facilitate a user using the coupled artwork frames 2200 as a hand tool for servicing their weapons and/or other objects. Note that the registration marks can be located on the tool chucks 2217 and/or the stop 2216. Although in some embodiments they are only located on the surfaces of the tool chucks 2217 which abut one another when the artwork frames 2200 are in the closed configuration shown in FIG. 20. Moreover, one set of registration marks 2522 can be located on the side of the artwork frame 2200 defined by the male coupling 2214 while the complimentary set of registration marks 2524 can be located on the female side of the artwork frames 2200. Thus, when the artwork frames 2200 are brought toward the closed position, the registration marks 2522 and 2524 will contact their complimentary marks, FIG. 25 also shows that in some embodiments the ridges 2520 are sized, dimensioned, and located so that the artwork frames 2200 can slide onto a tactical rail. However, artwork frames 2200 of embodiments can include ridges 2520 sized, dimensioned, and located so that the artwork frames 2200 can be pressed onto tactical rails with the ridges flexing enough to accept the corresponding portions of the tactical rails. Moreover, the ridges 2520 can be adapted so that they are flexed enough such that they press against the tactical rails and are therefore more securely hold the artwork frames 2200 in place on the rails.

On the other hand, FIG. 25 also shows that artwork frames 2200 can include various features for retaining weapons tools in the various tool apertures. For instance, FIG. 25 illustrates that the retainers 2530 can be raised surfaces or bumps placed in the tool apertures. These retainers 2530 can be configured to produce a slight interference fit with the weapons tools when the tools are in the tool apertures. Thus, the increased friction between the weapon tools and the sides of the tool apertures (and/or retainers 2530) can serve to hold the weapons tools in the apertures more securely than would otherwise be the case.

FIG. 26 illustrates an end view of yet another artwork frame. As this drawing shows, the tool apertures 2518 defined by the female and male coupling halves 2012 and/or 2014 can penetrate the lengths of those coupling halves. In the alternative, one or more of these tool apertures 2518 can terminate in the interior of one or more corresponding coupling halves.

Also shown in FIG. 26 is the pair of stops 2416 forming a terminus for the tool aperture 2518 otherwise defined by the tool chucks 2317. Of course, one or both of the stops 2416 can be omitted from artwork frames of embodiments. In such embodiments, the tool aperture 2518 defined by the tool chucks 2317 can therefore be partly or entirely open through the length of the interlocked artwork frames 2200. Note also that whereas the artwork frames 2200 shown in FIGS. 25 and 26 have symmetrical groups of tool chucks 2317 this need not be the situation. Indeed, one side of some artwork frames have different numbers and/or differently positioned tool chucks 2317 and/or stops 2416.

Figure 27:
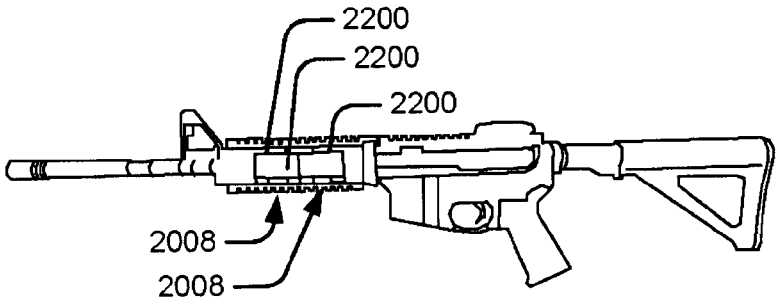
FIG. 27 illustrates a pair of artwork frames mounted on a weapon.
Figure 28:
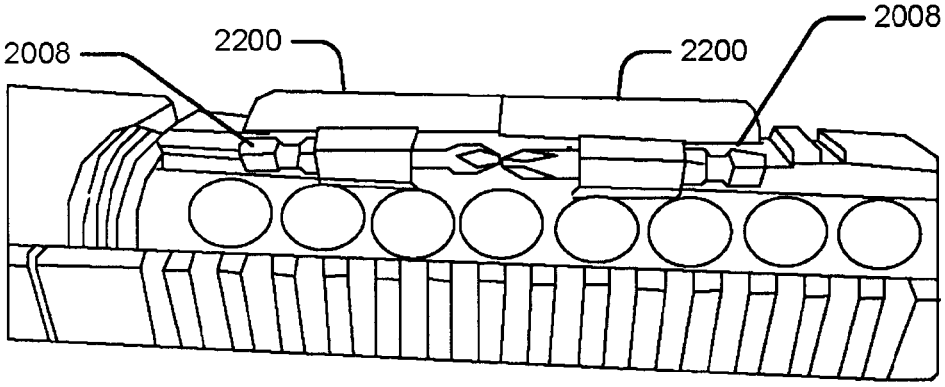
FIG. 28 illustrates another pair of artwork frames mounted on a weapon.
Figure 29:
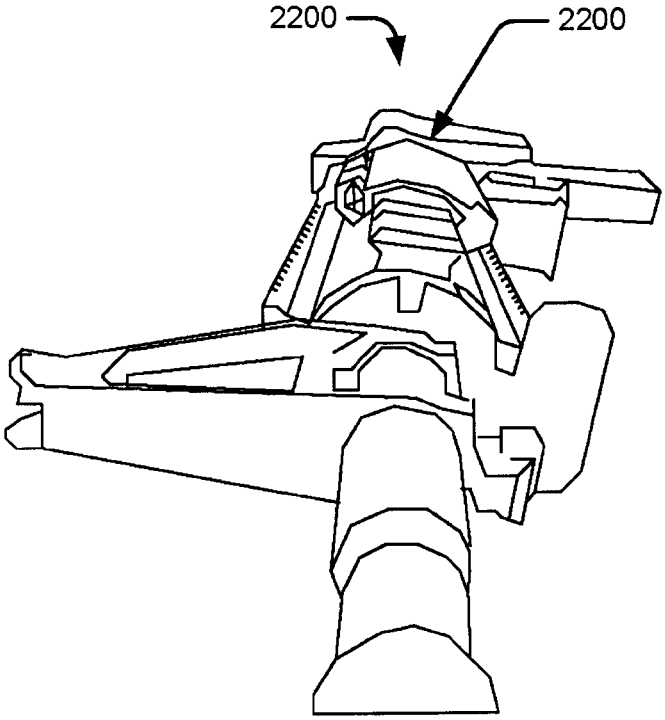
FIG. 29 illustrates a pair of artwork framed mounted on a weapon.
Figure 30:
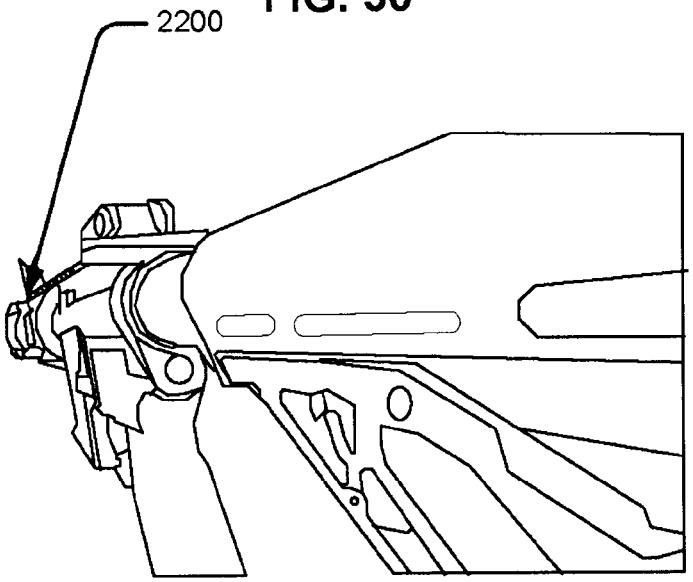
FIG. 30 illustrates another pair of artwork frames mounted on a weapon.

FIGS. 27-30 illustrate artwork frames of embodiments mounted on tactical rails for various weapons. For instance, FIG. 27 shows a pair of artwork frames 2200 mounted on the side rail of a weapon with a pair of weapons tools 2008 secured in the female couplings 2012 thereof. FIG. 28 moreover shows that a pair of weapons tools 2008 can be stored in the male coupling halves 2014 of a pair of artwork frames 2200 mounted on a weapon. FIG. 29, meanwhile, illustrates a perspective view of a pair of artwork frames 2200 mounted on a weapon as seen from the barrel end of the weapon. FIG. 30 shows a somewhat similar scene as seen looking from the butt or stock end of a weapon.

Figure 31:
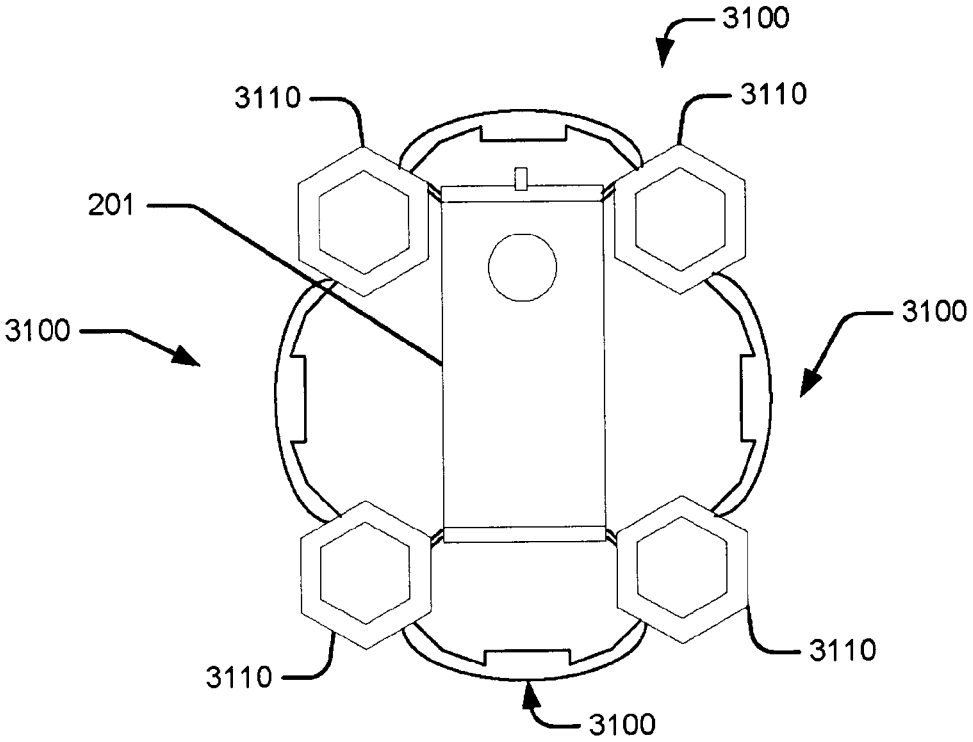
FIG. 31 illustrates a set of artwork frames mounted around a weapon.

FIG. 31 illustrates a set of artwork frames mounted around a weapon. More specifically, FIG. 31 illustrates that the artwork frames can be configured to surround a weapon. For instance, each artwork frame 3100 and its couplings 3110 can be adapted to engage tactical rails positioned on the various sides of a weapon such that the respective artwork displays and/or couplings 3110 register with each other although this need not be the situation. Note also that the artwork frames 3100 can have flat (or otherwise) display surfaces. Moreover, in some embodiments, the artwork on the various display surfaces can combine with the artwork on other display surfaces to form a piece-wise continuous piece of artwork wrapping (partially) around the weapon.

Figure 32:
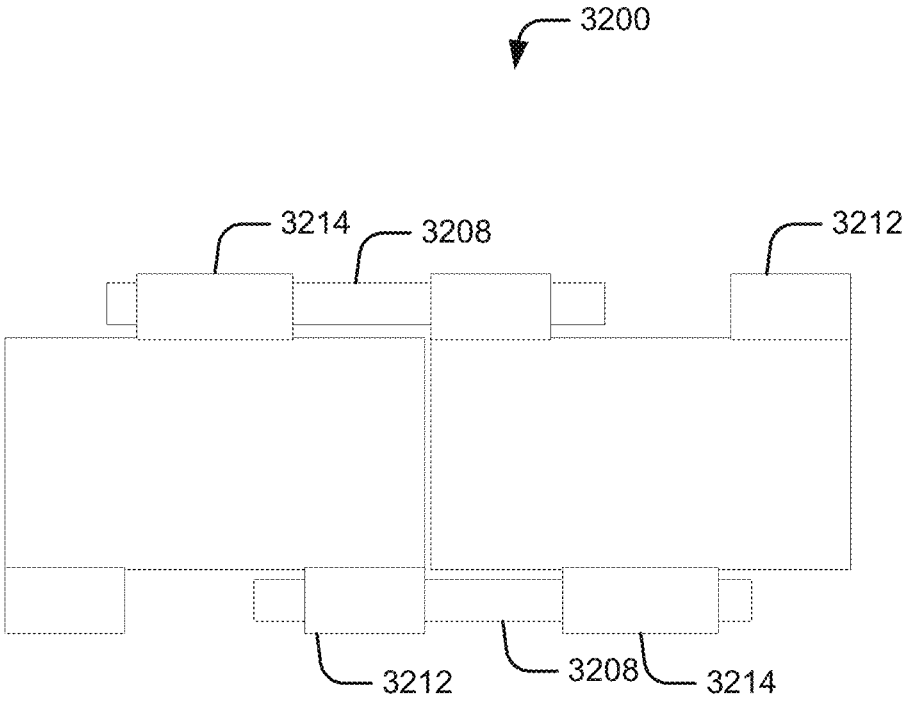
FIG. 32 illustrates a pair of artwork frames secured together by a weapons tool.

FIG. 32 illustrates a pair of artwork frames secured together by a weapons tool(s). More specifically, the artwork frames 3200 include female and male coupling halves 3212 and 3214. Moreover, one or more weapons tools 3208 are illustrated as being long enough to be positioned in the coupling halves of more than one artwork frame 3200. In the alternative, or in addition, the artwork frames 3200 can be configured such that the distances between their coupling halves 3212 and/3214 are short enough that the weapons tools 3208 can reach coupling halves on more than one artwork frame 3200.

Thus, various embodiments provide artwork frames 3200 that interlock and/or can be used in combination to (partially) enclose a weapon (as seen looking along the weapon). Further still, artwork frames are provided which provide a handle for a weapons tool to facilitate user comfort and/or provide mechanical advantage when using the artwork frames as a tool.

CONCLUSION

Although the subject matter has been disclosed in language specific to structural features and/or methodological acts, it is to be understood that the subject matter defined in the appended claims is not necessarily limited to the specific features or acts disclosed above. Rather, the specific features and acts described herein are disclosed as illustrative implementations of the claims.

The invention claimed is:

1. A frame for displaying a piece of artwork, the artwork frame comprising:

a frame portion adapted to display the piece of artwork, the artwork frame portion further comprising a frame body defining a first edge and a display area disposed on an exterior surface of the frame body;

a rail-engagement portion coupled to the frame portion and further comprising a pair of ridges extending generally inwardly from an interior surface of the frame body and being adapted to engage a tactical rail; and a first half of a coupling located at the first edge of the frame body and being adapted to mate with a second half of the coupling and to releasably couple the artwork frame to the second coupling half wherein the first coupling half defines a tool aperture adapted to receive a weapons tool.

2. The artwork frame of claim 1 wherein an engraving defines the piece of artwork.

3. The artwork frame of claim 1 wherein the second coupling half defines a tool aperture adapted to receive a weapons tool.

4. The artwork frame of claim 3 wherein the second coupling half further defines at least a portion of the rail engagement portion.

5. The artwork frame of claim 1 further comprising a first stop adapted to engage a groove of the tactical rail when the artwork frame is on the tactical rail.

6. The artwork frame of claim 5 wherein the first stop defines one half of at least a portion of a weapons aperture.

7. The artwork frame of claim 5 wherein the first stop defines an attachment point for a crush pad.

8. The artwork of claim 1 wherein the first coupling half defines at least a portion of the rail engagement portion.

9. A hand guard for a weapon including a barrel, the hand guard comprising:

a frame portion adapted to display the piece of artwork, the artwork frame portion further comprising a frame body defining a first edge and a display area disposed on an exterior surface of the frame body;

a rail-engagement portion coupled to the frame portion and further comprising a pair of ridges extending generally inwardly from an interior surface of the body and being adapted to engage a tactical rail; and a first half of a coupling located at the first edge of the frame body and being adapted to mate with a second half of the coupling and to releasably couple the hand guard to the second coupling half wherein the first coupling half defines a tool aperture adapted to receive a weapons tool.

10. The hand guard of claim 9 wherein an engraving defines the piece of artwork.

11. The hand guard of claim 9 wherein the second coupling half defines a tool aperture adapted to receive a weapons tool.

12. The hand guard of claim 11 wherein the second coupling half further defines at least a portion of the rail engagement portion.

13. The hand guard of claim 9 further comprising a first stop adapted to engage a groove of the tactical rail when the artwork frame is on the tactical rail.

14. The hand guard of claim 13 wherein the first stop defines one half of at least a portion of a weapons aperture.

15. The hand guard of claim 13 wherein the first stop defines an attachment point for a crush pad.

16. A frame for displaying a piece of artwork, the artwork frame comprising:

a frame portion adapted to display the piece of artwork, the artwork frame portion further comprising a frame body defining a first edge and a display area disposed on an exterior surface of the frame body;

a rail-engagement portion coupled to the frame portion and further comprising a pair of ridges extending generally inwardly from an interior surface of the frame body and being adapted to engage a tactical rail; and a first half of a coupling located at the first edge of the frame body and being adapted to mate with a second half of the coupling and to releasably couple the artwork frame to the second coupling half wherein the frame body further defines a second edge spaced apart from the first edge by the display area, the artwork frame further comprising a second coupling half located at the second edge of the frame body and being adapted to mate with a first coupling half of another artwork frame.

17. A hand guard for a weapon including a barrel, the hand guard comprising:

a frame portion adapted to display the piece of artwork, the artwork frame portion further comprising a frame body defining a first edge and a display area disposed on an exterior surface of the frame body;

a rail-engagement portion coupled to the frame portion and further comprising a pair of ridges extending generally inwardly from an interior surface of the body and being adapted to engage a tactical rail; and a first half of a coupling located at the first edge of the frame body and being adapted to mate with a second half of the coupling and to releasably couple the hand guard to the second coupling half wherein the frame body further defines a second edge spaced apart from the first edge by the display area, the artwork frame further comprising a second coupling half located at the second edge of the frame body and being adapted to mate with a first coupling half of another artwork frame.

* * * * *